United States Patent [19]

Takahashi

[11] 4,270,831

[45] Jun. 2, 1981

[54] ELECTRIC TERMINAL FOR PRESS-IN CONNECTION WITH CONDUCTORS

[75] Inventor: Toru Takahashi, Yokohama, Japan

[73] Assignee: Yamaichi Electric Mfg. Co., Ltd., Tokyo, Japan

[21] Appl. No.: 77,371

[22] Filed: Sep. 20, 1979

[30] Foreign Application Priority Data

Oct. 19, 1978 [JP] Japan ..... 53-127870

[51] Int. Cl.[3] ..... H01R 4/24

[52] U.S. Cl. ..... 339/99 R; 339/17 F; 339/97 C

[58] Field of Search ..... 339/96–100, 339/17 F, 176 MF, 174

[56] References Cited

U.S. PATENT DOCUMENTS

| | | | |
|---|---|---|---|
| 3,820,058 | 6/1974 | Friend | 339/176 MF X |
| 4,009,921 | 3/1977 | Narozny | 339/99 R |
| 4,118,096 | 10/1978 | Takahashi | 339/99 R |
| 4,133,596 | 1/1979 | Dauser | 339/98 |
| 4,188,083 | 2/1980 | Knowles | 339/99 R |

FOREIGN PATENT DOCUMENTS

| | | | |
|---|---|---|---|
| 2455354 | 5/1975 | Fed. Rep. of Germany | 339/99 R |

*Primary Examiner*—Eugene F. Desmond

*Attorney, Agent, or Firm*—Wenderoth, Lind & Ponack

[57] ABSTRACT

An electric terminal for the press-in connection with a conductor comprises three angular tines having a pair of first and a pair of second opposite plane surfaces extended longitudinally and inclined relative to the lateral sides of the angular tines for the purpose of obtaining complete and reliable connection between the electric terminal and the conductor. The electric terminal can effectively fulfill its function by installing a plurality of the electric terminals on a connector comprising a base block, a cover block and an intermediate block disposed between the two blocks.

7 Claims, 18 Drawing Figures

ELECTRIC TERMINAL FOR PRESS-IN CONNECTION WITH CONDUCTORS

BACKGROUND OF THE INVENTION

The present invention relates to an electric terminal for press-in connection with coated conductors, particularly a flexible flat cable incorporating therein a plurality of conductors which are arranged in parallel, and to a connector which has a plurality of the terminals described above.

There have heretofore been proposed connectors, which are capable of press-in connection between conductors and terminals by locating a flat cable between a pair of connector blocks and applying a high pressure to the connector blocks to thereby cause a plurality of terminals, which are disposed on one of the connector blocks, to pierce through the coating of the flat cable. However, in view of the fact that a tight connection within a limited space is desired, the connectors of this type require that the distances between the tines of the terminals for the connection with the conductors be shortened as much as possible without failing to obtain a reliable electric connection. More particularly, as the conductors incorporated in a flat cable are closely arranged in position, the distance between the adjacent terminals should be proportionally shortened.

The present inventor has previously proposed a terminal for the press-in connection with a coated cable such as a flat cable (Japanese Patent Public Disclosure No. Sho 50(1975)-80489). This termina! will be described hereinafter with reference to FIG. 1(A) and FIG. 1(B).

The terminal includes three tines 1, 2, and 3 which have a rectangular lateral cross section, and are arranged as illustrated. The coated conductors such as those located in a flat cable 6 are inserted, under pressure, in the press-in openings a' which is formed between the first tine 1 and the third tine 3 and between the second tine 2 and the third tine 3. At this time, the coating **6*b* of the conductors is broken through by the tines and thereby, there can be obtained the electric connection between the respective conductors and the corner edges a of the tines which are opposite to each other relative to the press-in openings a'. This type of terminal has a disadvantage in that since the press-in openings a' which are formed between the corner edges a of the tines are required to be large enough for the conductors to be inserted, the terminal cannot satisfy the requirement of shortened distances between the tines. When the distances between the tines are shortened by making the thickness of the tines small, there arise problems from the manufacturing point of view, i.e. problems with regard to the strength of the terminals and with regard to the processing technique. This terminal has further disadvantages in that since the connection is attained by causing the sharp corner edges a to be forcibly engaged with the conductors 6*a***, there is some possibility that the conductors will be cut and that, since the tips of the corner edges a are brought into connection with the conductors, i.e. the connecting area therebetween is very small, a highly reliable connection cannot be obtained.

In view of the disadvantages of the prior terminals described above, the present invention is proposed.

SUMMARY OF THE INVENTION

An object of the present invention is to provide a terminal for press-in connection with coated conductors, which terminal is suitable for conductors which are disposed close to each other and which makes possible obtaining a highly reliable connection without causing the conductors to be cut.

Another object of the present invention is to provide a block connector which includes a plurality of the aforedescribed terminals.

To attain the objects described above, according to the present invention, there is provided a terminal for the press-in connection with a conductor, which includes a first angular tine, a second angular tine which is oppositely disposed at the same angle as that of the first angular tine and at a given interval, and a third angular tine which is disposed in a different angle from that of the first and second angular tines so that the center thereof is on the lateral center line of the interval space between the tines, the first and third angular tines having first opposing plane surfaces for connection with the conductor each extending longitudinally and disposed on a corner which is made up by two sides of the tine so as to end, at a slant, at each of the two sides of the tine. The first opposite plane surfaces define therebetween a first press-in opening for the conductor, the second and third angular tines having second opposing plane surfaces for the connection with the conductor each extending longitudinally and disposed on a corner which is made up by two sides of the tine for ending, at a slant, at each of the two sides of the tine. The second opposite plane surfaces define therebetween a second press-in opening for the conductor, the slants of the first opposite plane surfaces being in a reverse direction to those of the second opposite plane surfaces respectively, whereby the conductor is inserted under pressure in the first and second press-in openings and brought into contact with the first and second opposite plane surfaces thereby resulting in a complete and reliable electric connection between the conductor and the terminal. There is also provided a connector which includes a base block which has a plurality of the above-described terminals arranged in at least two parallel rows in a rising arrangement, an intermediate block having a plurality of holes for allowing the passage of the terminals and holding the basal portions of the first, second and third tines of the terminals therein, and a cover block having a plurality of holes for holding the top portions of these tines therein.

The other objects and characteristic features of the present invention will become apparent from the following description which is given in detail with reference to the accompanying drawings.

DETAILED DESCRIPTION OF PREFERRED EMBODIMENTS

Figure 1A:
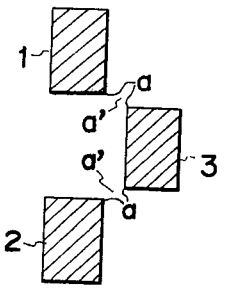
FIG. 1(A) is a lateral cross section of a prior art existing terminal for press-in connection with conductors.

The present invention will now be described in detail with reference to the illustrated preferred embodiments as shown in the drawings.

Figure 2:
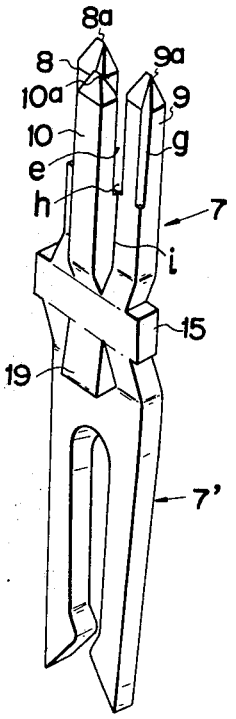
FIG. 2 is a perspective view of a terminal for press-in connection with conductors according to the present invention.
Figure 3:
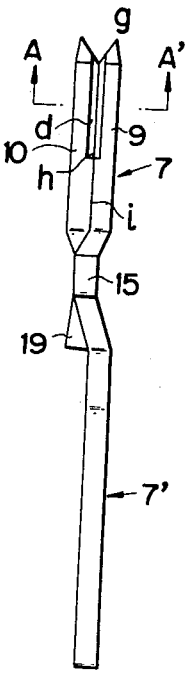
FIG. 3 is a front view of the terminal shown in FIG. 2.
Figure 7:
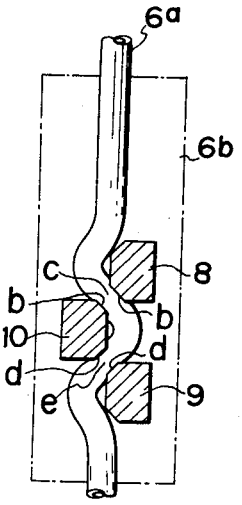
FIG. 7 is a lateral cross section view of the terminal illustrating the state in which a conductor is subjected to press-in connection with the terminal.
Figure 4A:
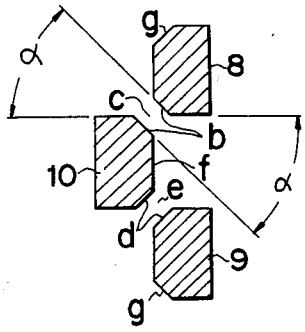
FIG. 4(A) is a lateral cross section view of the terminal taken along the line A—A' of FIG. 3.

FIG. 2 is a perspective view of a terminal 7 for use in press-in connection with a conductor according to the present invention. FIG. 3 is a front view of the terminal of FIG. 2. FIG. 4 is a lateral cross section view of the terminal. As shown, the terminal 7 of the present invention includes, as a unit, at least three angular tines 8, 9, and 10, each having pointed portions 8*a*, 9*a*, and 10*a* respectively, and includes an integral downwardly extending wiring terminal portion 7'. The terminal, which has the wiring terminal portion integral therewith is made of an electroconductive material such as a beryllium-copper alloy, or a phosphorus-copper alloy, etc. The first and second angular tines 8 and 9 are parallel and symmetrically disposed opposite to each other at a given interval, and the third angular tine 10 is disposed shifted away from the first and second angular tines so that the center thereof is on a line which extends at 90° from the center of the space between the first and second tines, as shown in FIG. 4(A). The first and third angular tines 8 and 10 have first opposite plane surfaces b and b for connection with the conductor each extending longitudinally and disposed on a corner which is formed by two sides of the tine so as to end at a slant at each of the two sides of the tine. The first opposite plane surfaces define therebetween a first press-in opening c for the conductor. In the same manner, the second and third angular tines 9 and 10 have second opposing plane surfaces d and d for the connection with the conductor, each extending longitudinally and disposed on a corner which is formed by two sides of the tine so as to connect at each end, at a slant to the two sides of the tine, and the second opposing plane surfaces define therebetween a second press-in opening e for the connector. The first opposing plane surfaces b and b are preferably longitudinally parallel to each other. It is also preferable that the second opposing plane surfaces d and d be longitudinally parallel to each other. Referring to FIG 4(A), the angle $\alpha$ between the first opposing plane surface b of the third angular tine 10 and one side of the first angular tine 8, or by the first opposing plane surface of the first angular tine and one side of the third angular tine is preferably approximately 45°. The angle between the second opposing plane surface d and one side in relationship to the second angular tine 9 and the third angular tine 10, is preferably the same as the angle $\alpha$ described above. In other words, any one of the first and second opposing plane surfaces and the side of the tine connected to the opposite plane surface form an angle of approximate 135°.

Figure 5A:
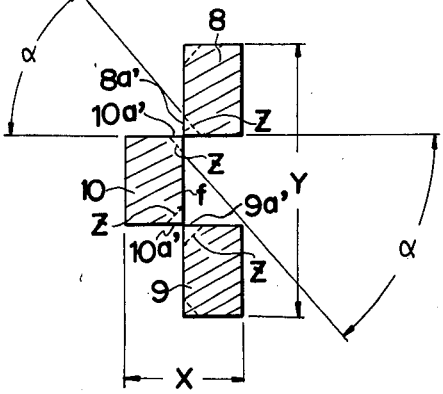
FIG. 5(A) is an explanatory lateral cross section view of the terminal illustrating the state wherein the first and second opposing plane surfaces and the first and second press-in openings are formed.
Figure 5B:
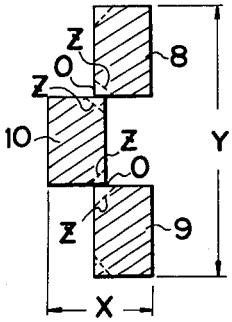
FIG. 5(B) is an explanatory lateral cross section view of the terminal illustrating another embodiment of the relationship between the opposing plane surfaces and press-in openings.

FIGS. 5(A) and 5(B) respectively show the three angular tines 8, 9 and 10 arranged without the first and second opposite plane surfaces b and d having been cut to define the first and second press-in openings c and e. In the case of the embodiment as shown in FIG. 5(A), the three angular tines 8, 9 and 10 are disposed so that the opposite corner portions 8*a*', 10*a*' and 9*a*', 10*a*' almost come into contact with each other and are subjected to surface processing (plastic working) along an imaginary lines z which intersects the respective two sides which make up the corner portions. The result is that the first and second opposite plane surfaces b and d and the first and second press-in openings c and e are formed. In this case, the third angular tine 10 has a side f which is connected to both the first and second opposite plane surfaces thereof, and the first and second angular tines 8 and 9 preferably have surface portions g and g respectively which serve for guiding the ends of the conductor to be inserted under pressure into the first and second press-in openings. With regard to the surface processing used, swaging is preferred. According to the swaging operation, the cross-sectional area of the angular tine is decreased a little which results in a strain hardening phenomenon, and thus, the mechanical strength of the angular tine is effectively be increased. In the terminal as thus constructed (FIG. 4(A)), a pair of sides of the first angular tine 8 which are connected to the first opposite plane surface and a pair of sides of the third angular tine 10 which are connected to the first opposite plane surface are disposed at a pair of planes which intersect each other at right angles, and a pair of sides of the second angular tine 9 connected to the second opposite plane surface and a pair of sides of the third angular tine 10 connected to the second opposite plane surface are disposed in another pair of planes which intersect each other at right angles. Therefore, the lateral and longitudinal widths of the terminal of this embodiment can be made shorter, than those of the prior art existing terminal which is shown in FIG. 1(A), by the dimensions which correspond to the press-in openings a' of the prior art terminal. In another embodiment, as shown in FIG. 5(B), the third angular tine 10 is disposed so as to partially intersect the space between the first and second angular tines 8 and 9 so as to contact the first and second annular tines surfaces o and o, and the portions of the three angular tines including the contacting surfaces are subjected to surface processing, preferably swaging operations, so as to form the first and second opposite plane surfaces b and d and the first and second press-in openings c and e. According to this embodiment, the lateral and longitudinal widths of the terminal can be made shorter than those of the terminal of the preceding embodiment by the dimensions corresponding to the contacting surfaces o.

Figure 4B:
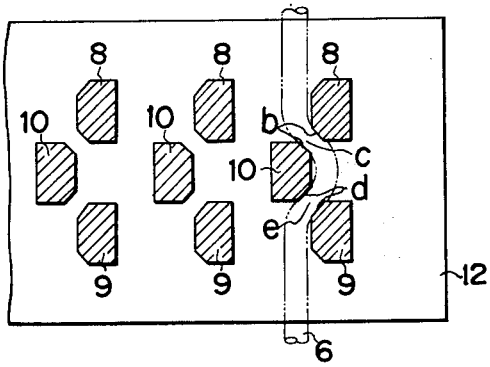
FIG. 4(B) is a lateral cross section view of a plurality of the terminals shown in FIG. 4(A).

According to the present invention, the lateral width X and the longitudinal width Y of the terminal can be made shorter than those of the prior art terminal as shown in FIG. 1(A), at least by the dimensions corresponding to the press-in openings a' of the existing terminal. When a plurality of the present terminals 7 are arranged as shown in FIG. 4(B) and located on a base block 12 of a connector, the shortened widths are compounded on each other and, therefore, the connector itself can be considerably miniaturized.

The first and second opposing plane surfaces b and d extend from the top to the middle of the angular tines 8, 9 and 10. The first and second press-in openings c and e define on the lower extremities thereof, a press-in bottom portion h under which the separated connecting portions i of the angular tines are located. The angular tines 8, 9 and 10 extend from their connecting portion which is integral with a press-in plate 15. The wiring terminal portion 7' integrally extends from the lower surface of the press-in plate 15. The separated portions i serve the purpose of affording good resiliency to the angular tines. When the separated portions i are formed by contact along the corner edges of the angular tines 8, 9 and 10, the angular tines are supported by the contacting portions so as to be secured in their respective positions and, therefore, possible bending, displacement, etc. can be effectively prevented.

Figure 13:
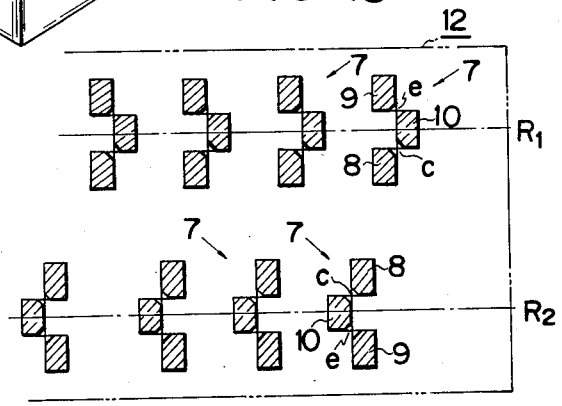
FIG. 13 is a lateral cross section view of the portions of the terminals in the base block, showing the state in which the terminals are arranged.
Figure 10:
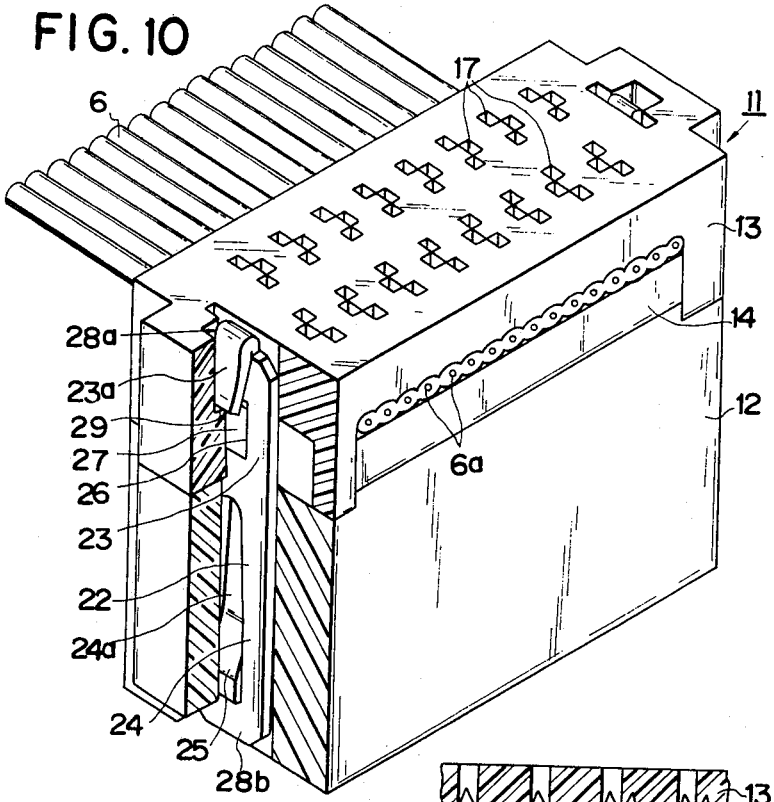
FIG. 10 is a perspective view of the connector, with a portion of a lock plate in cross-section, showing the state in which the connector is assembled.
Figure 12:
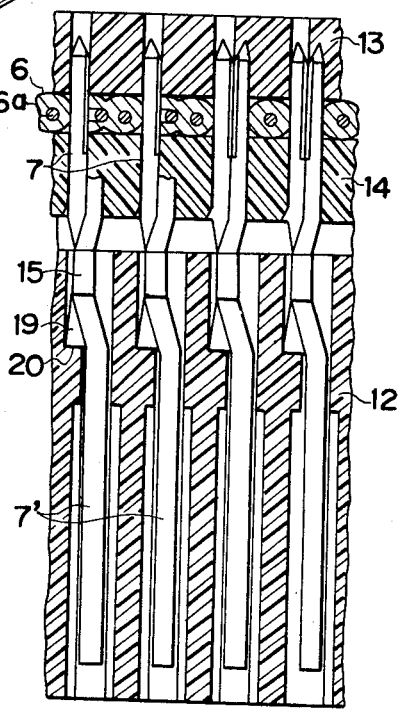
FIG. 12 is a partial longitudinal cross section view of the connector showing the state in which the connector is assembled.

FIGS. 8–12 show a connector 11 of the present invention for press-in connection with a flat cable. The connector has a plurality of the terminals of the present invention arranged in two rows $R_1$ and $R_2$ as shown in FIG. 13. The connector 11 includes a base block 12 for receiving the terminals therein, a cover block 13 for applying pressure thereto and an intermediate block 14 which is disposed between the cover block and the base block for securing the positions of the terminals. The blocks are united by a lock means. More particularly, the connector 11 has a pair of lock plates 22 for uniting the base block 12, the cover block 13 and the intermediate block 14 into one piece. Each of the lock plates 22 has a hole 26 in the middle which has a fitting projection 27, which is located on the end side of the intermediate block 14, detachably engaged therein. An upper insertion plate portion 23 is inserted in a slot **28*a* which has been bored into the end side of the cover block 13, a lower insertion plate portion 22 is inserted in another slot 28*b* which has been bored into the end side of the base block 15, an upper engaging projection 23*a* is formed by bending the upper insertion plate portion 23 and resiliently engaging it with a stepped stop portion 29 which has been formed on the inner wall of the slot 28*a* of the cover block 13, and a lower engaging hole 24 which has been bored into the lower insertion plate portion 22 has a stop projection 25, which is located on the inner wall of the slot 28*b* of the base block 12, resiliently engaged therein. Since the lock plate 22 can be easily prepared by merely subjecting a plate member to punching and bending processes. The lock means for uniting the three blocks 12, 13 and 14 can thus be made to have a simple and thin shape. Thus, the space for installing the lock means can be decreased and the connector can be miniaturized. Further, the lock plates 22 can be used to firmly unite the three blocks 12, 13 and 14** and can easily be attached to and detached from the three blocks.

The terminals 7 are inserted into planting holes 16, which have been bored into the base block 12, and are secured by inserting the pressure plates 15 on the middle portions of the under pressure terminals 7 into the inner walls of the planting holes and thereby causing protuberances 19, which are located under the press-in plates 15, to be engaged with stepped portion 20 which has been formed inside the planting holes 16. The angular tines 8, 9 and 10 protrude from the upper surface of the base block 12. The cover block 13 and the intermediate block 14 have insertion holes 17 and 18 for holding the angular tines 8, 9 and 10 therein respectively. The base portions of the angular tines 8, 9 and 10 are inserted into the insertion holes 18 of the intermediate block 14 and the top portions of the angular tines 8, 9 and 10 protrude from the upper surface of the intermediate block, i.e. from the insertion holes 18, and are inserted into the insertion holes 17 of the cover block 13. Since the intermediate block 14 causes the base portions of the angular tines 8, 9 and 10 to be held inside the insertion holes 18, it functions to secure the accurate press-in positions of the angular tines 8, 9 and 10, and to reinforce the angular tines and prevent deformation of the angular tines which can possibly occurs when the conductors are inserted under pressure into the press-in openings. The insertion holes 17 and 18 are exactly in accord with each other when the cover block 13 for the application of pressure is fitted onto the intermediate block 14 for the arrangement of the terminals.

Figure 11:
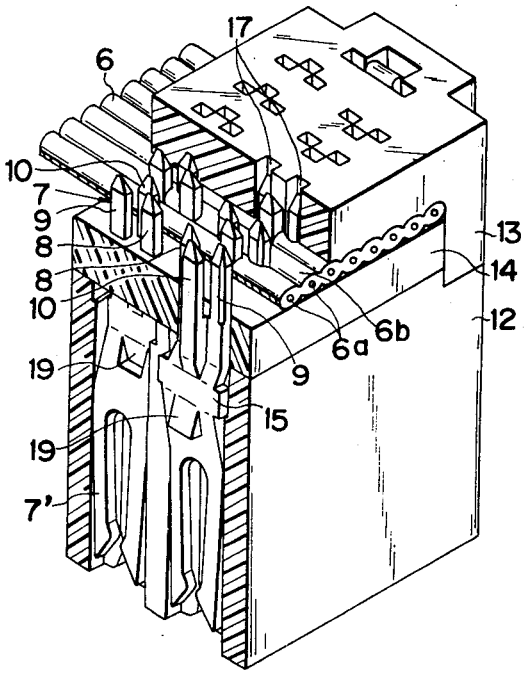
FIG. 11 is a perspective view of the connector with the portions of terminals in cross-section, showing the state in which the connector is assembled.
Figure 9:
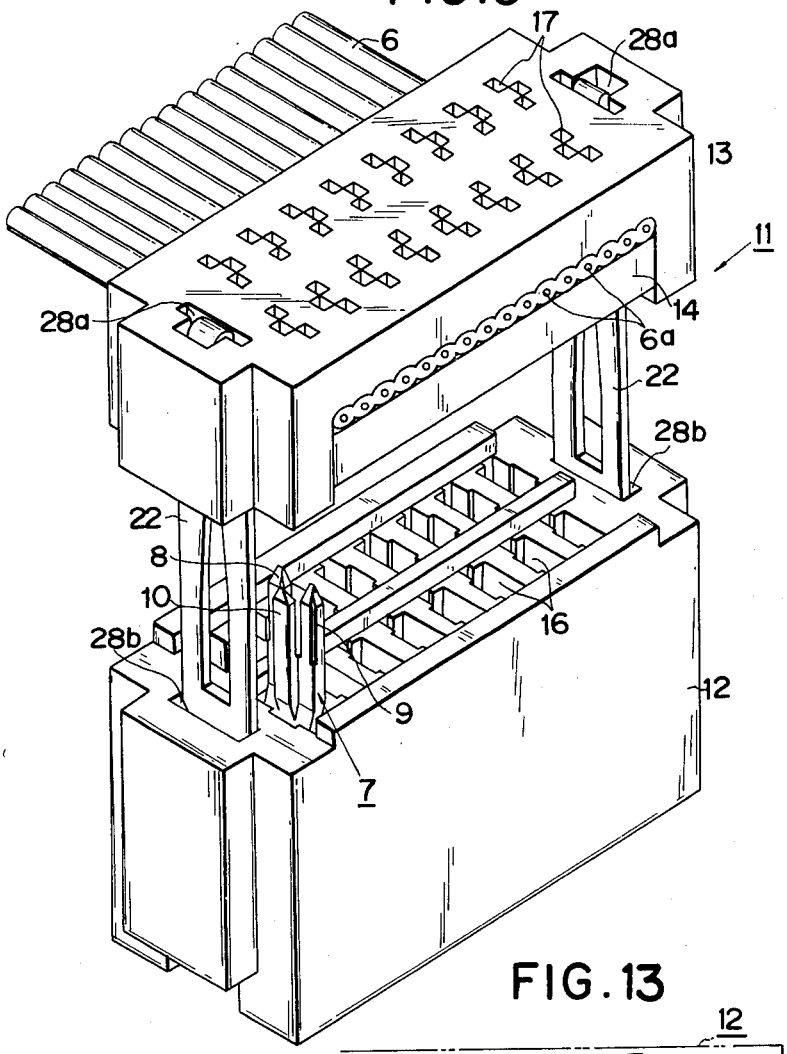
FIG. 9 is an exploded perspective view of the cover block of FIG. 8 with the intermediate block mounted thereunder and a base block for the mounting of terminals. The base block is an element making up the connector of the present invention.

The flat cable 6 is placed between the cover block 13 and the intermediate block 14 (FIG. 9), and the two blocks are united under pressure with the base block 12 (FIG. 10) and, as a result, the pointed portions **8*a*, 9*a* and 10*a* of the angular tines 8, 9 and 10 are inserted in the insertion holes 18 of the intermediate block 14, and then caused to pierce through the coating 6*b* of the flat cable, and finally inserted into the insertion holes 17 of the cover block 13 (FIG. 11). As a result, the conductors 6*a* are inserted under pressure into the press-in openings of the terminals, and the electric connection between the conductors and the terminals is obtained. The state of the connection between the conductors and the respective terminals will be better understood from reference to FIGS. 11 and 12. More specifically, after the pointed portions 8*a*, 9*a* and 10*a* of the angular tines 8, 9 and 10, which make up the terminal 7 have broken through the coating 6*b*, the conductor 6*a* is pressed-in toward the bottom portion h of the first press-in opening c while it is brought firmly into slidable contact with the first opposing plane surfaces b, and at the same time it is pressed-in toward the bottom portion h of the second press-in opening e while it is brought firmly into slidable contact with the second opposing plane surfaces d. The conductor is bent as result of this action. As a result, the conductor 6a fulfills its function at the surface contact portions and by having a desirable connection which can be obtained. Since the conductor 6a comes into surface contact with the first and second opposite plane surfaces b, d, the cutting phenomenon of the conductor which can occur due to contact with the corner edge a as shown in FIG. 1** can effectively be prevented and, further, since the area of the connection between the conductor and the terminal is larger than that in the prior art terminal, reliability in the connection is considerably improved.

Figure 6A:
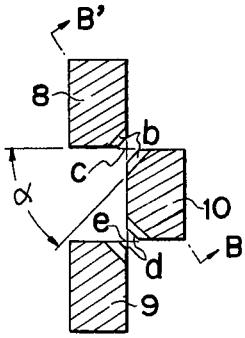
FIG. 6(A) is a lateral cross section view of the terminal illustrating another embodiment of the first and second opposing plane surfaces.
Figure 6B:
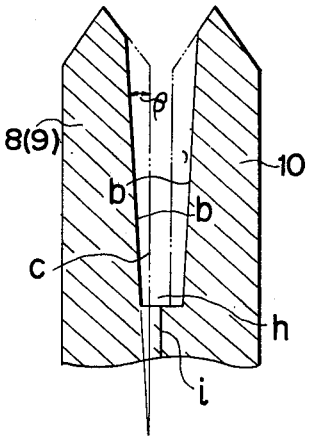
FIG. 6(B) is a longitudinal cross section view of the terminal taken along the line B—B' of FIG. 6(A).
Figure 6C:
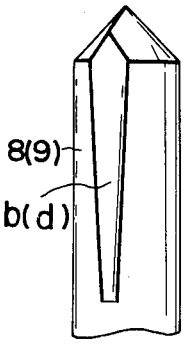
FIG. 6(C) is a front view of the tines of the terminal of FIG. 6(A).
Figure 8:
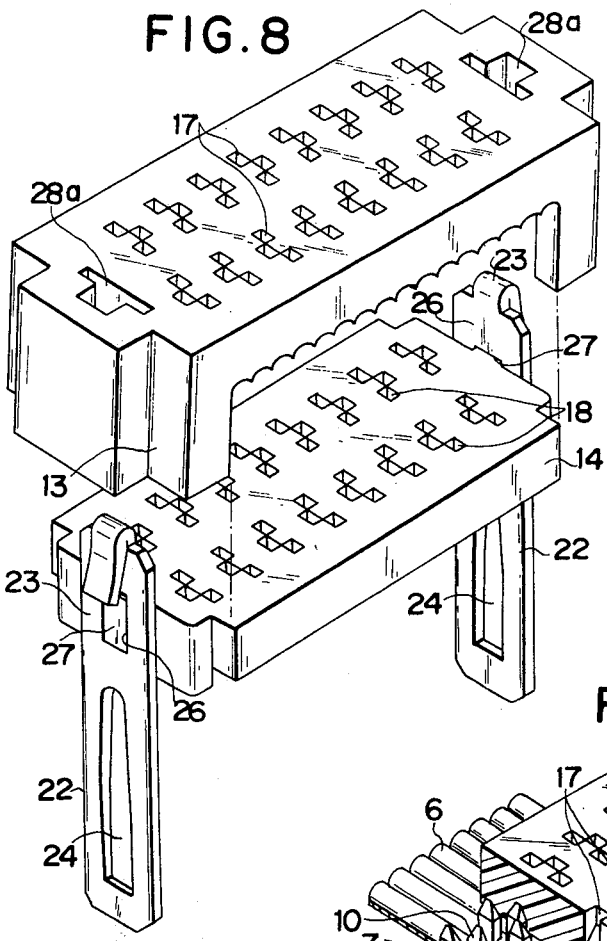
FIG. 8 is an exploded perspective view of a cover block for applying pressure, and an intermediate block for use in arranging the terminals. The blocks are the elements making up the connector according to the present invention.

FIG. 6 illustrates another embodiment of the terminal according to the present invention. As shown in FIG. 6(B) which is a longitudinal cross section view of the terminal, the first and second opposite plane surfaces b and d are longitudinally inclined at an angle of $\beta$ relative to the plan sides of the angular tines 8, 9 and 10 in addition to the lateral inclination of the first and second opposite plane surfaces at an angle of $\alpha$ relative to the lateral sides of the angular tines of which the lateral inclination is the same as that of the preceding embodiment which has been described, and is shown in FIG. 6(A). In this embodiment, the press-in openings c and e are gradually decreased by the angle of $\beta$ toward the bottom portions h thereof. As a result, proportionally, as the insertion of the conductor 6a under pressure is performed, the pressure on the conductor is gradually increased and the surface pressure contact between the conductor and the opposite plane surfaces b and d is greater. Therefore, the reliability in the connection between the terminal 7 and the conductor 6a at the opposite plane surfaces b and d is further enhanced.

As described above, the present invention has made it possible to miniaturize an electric terminal for press-in connection with conductors and to shorten the space for installing a plurality of terminals on a connector and, therefore, it sufficiently fulfills the requirement of highly close connection of the conductors. Further, since the widths X and Y of the terminal can be shortened without decreasing the thickness of the angular tines by disposing the angular tines as shown in FIGS. 5(A) and 5(B), the present invention completely satisfies the recent requirement that the interval between the conductors in a flexible flat cable be highly close. The above-described requirement gives attention to the fact of having thin conductors and the present invention can effectively avoid the cutting phenomenon of the conductors at the connecting portions and maintain the good state of connection even when the thickness of the conductors is made small. Further, it is clear that the terminal of the present invention can be made up of four or more angular tines without. In the case of the terminal having four angular tines, the fourth angular tine can have the same relationship as the relationship as the third angular tine 10 to the first angular tine 8 or to the second angular tine 9.

What is claimed is:

1. An electrical connector for press-in connection with a conductor, said connector comprising:

a base;

a first rectangular tine, a second rectangular tine and a third rectangular tine, each extending upward from said base, said first rectangular tine and said second rectangular tine located adjacent and spaced sideways from each other and said third rectangular tine located displaced laterally away from a line which extends between said first and second rectangular tines and adjacent the center of the space between said first and second rectangular tines, the front surfaces of said first and second rectangular tines facing in the direction in which said third rectangular tine is laterally displaced and opposite the direction of facing of the front surface of said third rectangular tine, and said first, second and third rectangular tines positioned so that the side surfaces of said first and third rectangular tines, which are closest each other, define an $x_1$ axis, the side surfaces of said third and second rectangular tines, which are closest each other, define an $x_2$ axis which is parallel to said $x_1$ axis, and the front surfaces of said first, second and third rectangular tines are aligned to define a y axis which is perpendicular, in the same plane, to said $x_1$ and $x_2$ axes;

a first bevel surface on said first rectangular tine at the corner closest said third rectangular tine, a third bevel surface on said third rectangular tine at the corner closest said first rectangular tine, said first and third bevel surfaces being spaced from and facing each other for defining a first space for receiving a conductor therein;

a second bevel surface on said second rectangular tine at the corner closest said third rectangular tine, a fourth bevel surface on said third rectangular tine at the corner closest and said second rectangular tine, said second and fourth bevel surfaces being spaced from and facing each other for defining a second space for receiving a conductor therein; and whereby a conductor can be inserted into said first and second spaces between said bevel surfaces for establishing a physical and electrical connection between said terminal and the conductor through direct contact between the conductor and said bevel surfaces.

2. An electrical connector as in claim 1 wherein each said bevel surface is disposed at an angle of 135° with respect to both the side and front surface of the corresponding rectangular tine.

3. An electrical connector as in claim 1 wherein said first and third beveled surfaces are parallel to each other and said second and fourth beveled surfaces are parallel to each other.

4. An electrical connector as in claim 1 wherein said bevel surfaces are longitudinally inclined for decreasing the size of said first and second spaces at the bottom portions of said rectangular tines.

5. An electrical connector for press-in connection with a conductor, said connector comprising:

a plurality of electric terminals, each comprising;

a base, a first rectangular tine, a second rectangular tine and a third rectangular tine, each extending upward from said base, said first rectangular tine and said second rectangular tine located adjacent and spaced sideways from each other and said third rectangular tine located displaced laterally away from a line between said first and second rectangular tines and adjacent the center of the space between said first and second rectangular tines, the front surfaces of said first and second rectangular tines facing in the direction in which said third rectangular tine is laterally displaced and opposite the direction of facing of the front surface of said third rectangular tine, and said first, second and third rectangular tines positioned so that the side surfaces of said first and third rectangular tines, which are closest each other, define an $x_1$ axis, the side surfaces of said third and second rectangular tines, which are closest each other, define an $x_2$ axis which is parallel to said $x_1$ axis, and the front surfaces of said first, second and third rectangular tines define a y axis which is perpendicular, in the same plane, to said $x_1$ and $x_2$ axes, a first bevel surface on said first rectangular tine at the corner closest said third rectangular tine, a third bevel surface on said third rectangular tine at the corner closest said first rectangular tine, said first and third bevel surfaces spaced opposite and parallel to each other for defining a first space for receiving a conductor therein;

a second bevel surface on said second rectangular tine at the corner closest said third rectangular tine, a fourth bevel surface on said third rectangular tine at the corner closest said second rectangular tine, said second and fourth bevel surfaces spaced opposite and parallel to each other for defining a second space for receiving a conductor therein, whereby a conductor can be inserted into said first and second spaces between said bevel surfaces for establishing a physical and electrical connection between said terminal and the conductor through direct contact between the conductor and said bevel surfaces;

a base block having a shape for receiving said plurality of terminals in at least two parallel rows;

an intermediate block having a plurality of holes for allowing each tine of each terminal of said plurality of terminals to pass therethrough and for holding the base portion of each rectangular tine thereon; and a top block having a plurality of openings for receiving and holding the tops of said rectangular tines which protrude from the top of said intermediate block.

6. A connector as in claim 5 further comprising lock means for holding said base block, intermediate block, and top block together in one piece.

7. A connector as in claim 6 wherein said lock means comprises each of said base and top blocks having an opening at opposite extremities for defining one opening at each extremity when said base, intermediate, and top blocks are assembled together in one piece;

a projection at each extremity of said intermediate block;

a projection at each extremity of said base block within said one opening;

a step-like recess within the wall of said one opening at each extremity of said top block; and a plate, positioned at each extremity of said blocks within said one opening, said plates having a first hole and a second hole for being engaged at said first hole by said intermediate block projection and engaged at said second hole by said base block projection, said plate further having an engaging member at the top thereof for engaging said top block at said step-like recess for holding said base block, intermediate block and top block together in one piece.

* * * * *

UNITED STATES PATENT AND TRADEMARK OFFICE

CERTIFICATE OF CORRECTION

PATENT NO. : 4,270,831

DATED : June 2, 1981

INVENTOR(S) : Toru Takahashi

It is certified that error appears in the above—identified patent and that said Letters Patent is hereby corrected as shown below:

On The Title Page, the descriptive figure should appear as shown below:

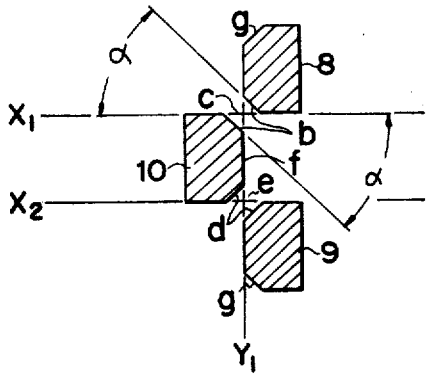

Figure 1B:
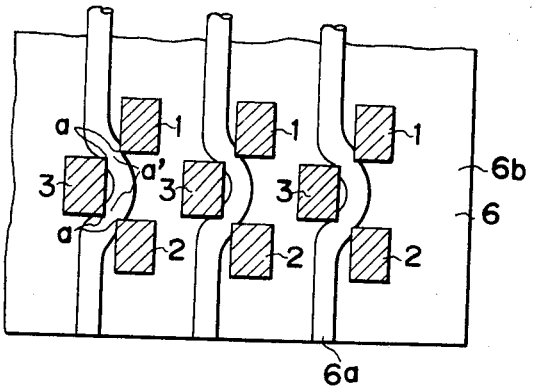
FIG. 1(B) is a lateral cross section of a plurality of the prior art existing terminals of FIG. 1(A) illustrating the condition wherein the conductors are subjected to press-in connection with the terminals.

Figures 1A and 1B, should appear as shown below:

FIG.1A

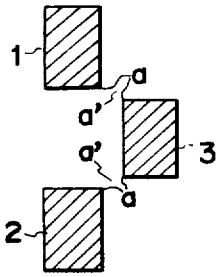

PRIOR ART

FIG.1B

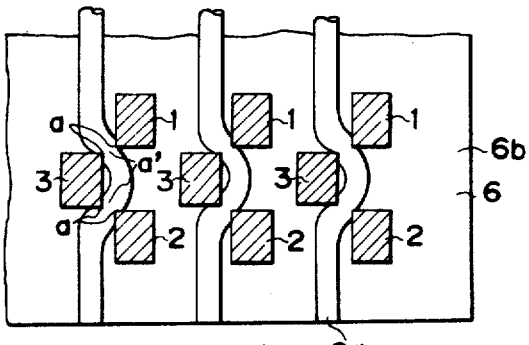

PRIOR ART

UNITED STATES PATENT AND TRADEMARK OFFICE

CERTIFICATE OF CORRECTION

PATENT NO. : 4,270,831 Page 2 of 2

DATED : June 2, 1981

INVENTOR(S) : Toru Takahashi

It is certified that error appears in the above—identified patent and that said Letters Patent is hereby corrected as shown below:

Figure 4A, should appear as shown below:

FIG.4A

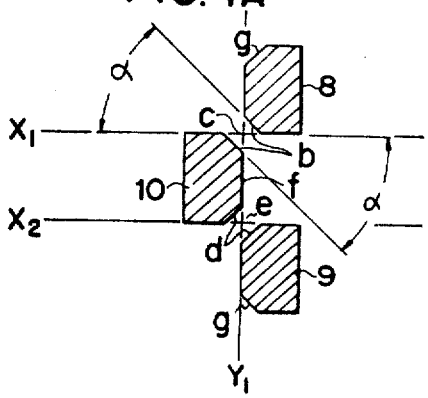

Column 7, line 52, after "without" insert -- departing from the scope of the invention --.

Signed and Sealed this

Second Day of March 1982

[SEAL]

Attest:

GERALD J. MOSSINGHOFF

Attesting Officer

Commissioner of Patents and Trademarks